US009103060B2

(12) United States Patent
Kim et al.

(10) Patent No.: US 9,103,060 B2
(45) Date of Patent: Aug. 11, 2015

(54) WASHING MACHINE AND METHOD OF OPERATING THE SAME

(75) Inventors: Youngjong Kim, Changwon-si (KR); Sangjun Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 1260 days.

(21) Appl. No.: 12/846,325

(22) Filed: Jul. 29, 2010

(65) Prior Publication Data

US 2011/0061171 A1 Mar. 17, 2011

Related U.S. Application Data

(60) Provisional application No. 61/230,500, filed on Jul. 31, 2009.

(30) Foreign Application Priority Data

Jul. 31, 2009 (KR) ..... 10-2009-0071050
Oct. 23, 2009 (KR) ..... 10-2009-0101380

(51) Int. Cl.

| | |
|---|---|
| ***D06F 33/00*** | (2006.01) |
| ***D06F 35/00*** | (2006.01) |
| ***D06F 37/40*** | (2006.01) |
| ***D06F 13/02*** | (2006.01) |
| ***D06F 17/06*** | (2006.01) |
| ***D06F 23/04*** | (2006.01) |

(52) U.S. Cl.

CPC ..... *D06F 35/006* (2013.01); *D06F 13/02* (2013.01); *D06F 17/06* (2013.01); *D06F 23/04* (2013.01); *D06F 37/40* (2013.01)

(58) Field of Classification Search

CPC ..... D06F 35/006; D06F 37/40; D06F 17/06; D06F 37/38; D06F 13/00; D06F 13/02; D06F 13/04; D06F 13/06; D06F 13/08; D06F 17/08; D06F 21/06; D06F 21/08; D06F 23/04

USPC ..... 8/158, 159

See application file for complete search history.

(56) References Cited

U.S. PATENT DOCUMENTS

| | | | | |
|---|---|---|---|---|
| 5,678,268 | A * | 10/1997 | Lee | 8/159 |
| 5,737,790 | A * | 4/1998 | Badger et al. | 8/158 |
| 2004/0016061 | A1* | 1/2004 | Broker et al. | 8/159 |
| 2004/0045097 | A1* | 3/2004 | Kim et al. | 8/159 |
| 2004/0139556 | A1* | 7/2004 | Lee et al. | 8/158 |
| 2004/0237212 | A1 | 12/2004 | Shaffer | |
| 2005/0160536 | A1* | 7/2005 | McAllister et al. | 8/137 |

(Continued)

FOREIGN PATENT DOCUMENTS

| | | |
|---|---|---|
| CN | 1521308 A | 8/2004 |
| JP | 61-164593 A | 7/1986 |

(Continued)

*Primary Examiner* — Michael Kornakov
*Assistant Examiner* — Marc Lorenzi
(74) *Attorney, Agent, or Firm* — Birch, Stewart, Kolasch & Birch, LLP

(57) ABSTRACT

The present invention relates to a washing machine and a method of operating the washing machine. In operating the washing machine according to inputted settings, each washing cycle is divided into a plurality of steps, and a washing tub or pulsator is controlled to be differently operated for each step. Accordingly, the washing machine may be operated in various patterns to effectively remove contaminants from the laundry.

7 Claims, 12 Drawing Sheets

(56) References Cited

U.S. PATENT DOCUMENTS

| | | | | |
|---|---|---|---|---|
| 2005/0217036 | A1* | 10/2005 | Park | 8/158 |
| 2007/0017262 | A1* | 1/2007 | McAllister et al. | 68/23.7 |

FOREIGN PATENT DOCUMENTS

| | | | |
|---|---|---|---|
| JP | 63-317189 | A | 12/1988 |
| WO | WO 2008/143528 | A1 | 11/2008 |

* cited by examiner (a)

(b)

WASHING MACHINE AND METHOD OF OPERATING THE SAME

CROSS-REFERENCE TO RELATED APPLICATION

This application claims the priority benefit of Korean Patent Application No. 10-2009-0071050, filed on Jul. 31, 2009 and 10-2009-0101380, filed on Oct. 23, 2009 in the Korean Intellectual Property Office, and U.S. Provisional Patent Application No. 61/230,500 filed on Jul. 31, 2009 in the USPTO, the disclosure of which is incorporated herein by reference.

BACKGROUND OF THE INVENTION

1. Technical Field

The disclosure is directed to a washing machine and a method of operating the washing machine, and particularly to, a washing machine and a method of operating the washing machine that may operate in various patterns during washing to effectively remove contaminants from the laundry.

2. Discussion of the Related Art

In general, a washing machine gets rid of unwanted materials from laundry. For this purpose, the washing machine performs washing, rinsing, and dehydrating processes.

The washing machine supplies detergent and washing water to a washing tub filled with laundry and rotates the washing tub to remove the unwanted materials from the laundry. Further, the washing machine rotates the washing tub and a pulsator to remove the unwanted materials. To get rid of the unwanted material, the washing machine alternately rotates the washing tub and the pulsator in one direction or in both directions.

A conventional washing machine rotates a washing tub at high speed in one direction to remove unwanted materials.

In the conventional washing machine, however, laundry in the washing tub may be worn while the washing tub is rotated at high speed in one direction. Further, rotating the washing tub in one direction may cause more energy consumption.

Further, the conventional washing machine performs a washing process in the same operation pattern although the washing process is different from rinsing and dehydrating processes. Moreover, the rinsing process is performed only in a preset pattern.

Such a repetition of simple operation leads to lowered washing efficiency compared to the washing time and increases wear of the laundry. Accordingly, there is a need for a more efficient washing method.

SUMMARY OF THE INVENTION

Exemplary embodiments of the present invention provide a washing machine and a method of operating the washing machine that diversify the operational patterns of a washing tub or pulsator so that the laundry may be moved in various patterns during washing, thus resulting in improved washing efficiency and performance.

According to an embodiment, there is provided a method of operating a washing machine comprising: a first washing process that alternately repeats rotating a pulsator in a direction and rotating the pulsator in an opposite direction during washing laundry to create a first frictional force between the laundry and separating contaminants from the laundry using the first frictional force; and a second washing process that alternately repeats rotating the pulsator in a direction and rotating the pulsator in an opposite direction during washing laundry to create a second frictional force larger than the first frictional force between the laundry and separating contaminants from the laundry using the first frictional force.

According to an embodiment, there is provided washing machine comprising: a washing tub in which laundry is put; a pulsator rotating in the washing tub; and a controller that variably controls at least one of a rotation direction, a rotation speed, and a rotation angle of the washing tub or the pulsator to create different frictional forces between the laundry so that a first washing process and a second washing process are performed by the different frictional forces during washing.

In the washing machine and the method of operating the washing machine configured as above, a washing cycle is divided into a plurality of steps in performing a preset course. And, the operational patterns of the washing tub or pulsator are diversified by allowing the washing tub or pulsator to have different operation speed, operation direction, operation level, and operation time. Accordingly, detergent may be effectively infiltrated into the laundry, the laundry may be moved in various patterns, and the strength of washing may be variously selected, thus improving washing capability while minimizing wear of the laundry. Further, energy consumption may be saved, thus resulting in washing efficiency.

DETAILED DESCRIPTION OF THE EXEMPLARY EMBODIMENTS

Hereinafter, embodiments of the present invention will be described with reference to the accompanying drawings.

Figure 1:
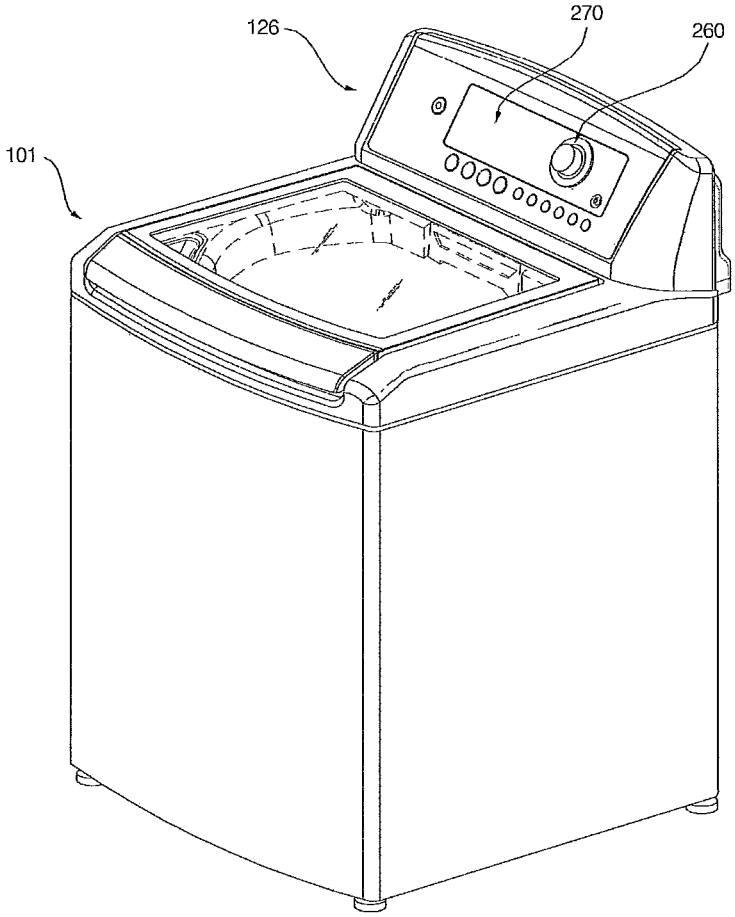
FIG. 1 is a perspective view illustrating a washing machine according to an embodiment of the present invention.
Figure 2:
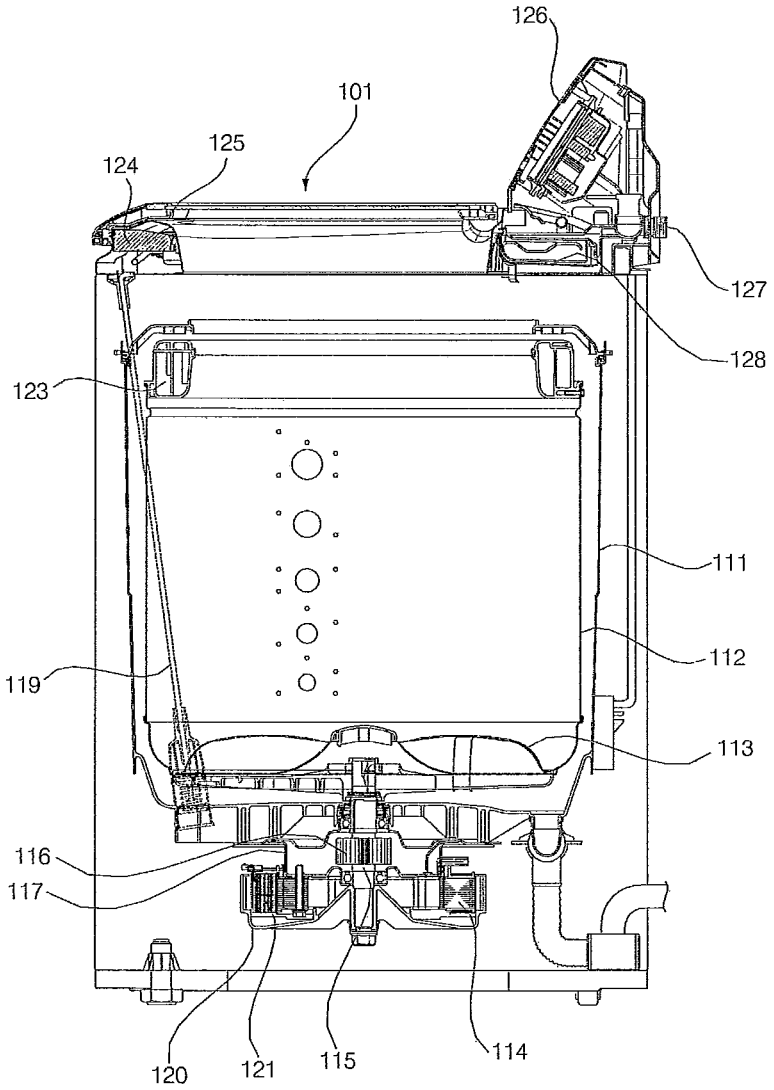
FIG. 2 is a cross sectional view illustrating the washing machine shown in FIG. 2.

FIG. 1 is a view illustrating a configuration of a washing machine according to an embodiment of the present invention, and FIG. 2 is a cross sectional view illustrating the washing machine shown in FIG. 1.

Referring to FIGS. 1 and 2, the washing machine 101 includes a cabinet and a water supply unit 127 that is located in the cabinet to supply washing water from an external source (not shown).

The washing machine 101 includes a reservoir 111 to store washing water supplied from the water supply unit 127. A washing tub 112 is arranged inside of the reservoir 111. Laundry is put and washed in the washing tub 112.

A driving unit 114 is arranged below the reservoir 111 to drive the washing tub 112. A drainage unit is arranged at a side of the cabinet to drain the reservoir 111 and the washing tub 112.

The driving unit 114 controls the rotation and speed of a rotation shaft, and includes a pulsator 113 and a clutch 115 that selectively rotates the washing tub 112.

The cabinet includes a cabinet body configuring the appearance and a top cover that is arranged at the top side of the cabinet body and connected with the cabinet body.

The top cover includes a laundry entrance/exit hole (not shown) to put in the laundry.

A lead assembly is rotatably connected to the top cover to open and close the laundry entrance/exit hole.

A control panel 126 is connected to a side of the top cover so that an input unit 260 is arranged in the control panel 126 to receive an input signal from a user.

Figure 3:
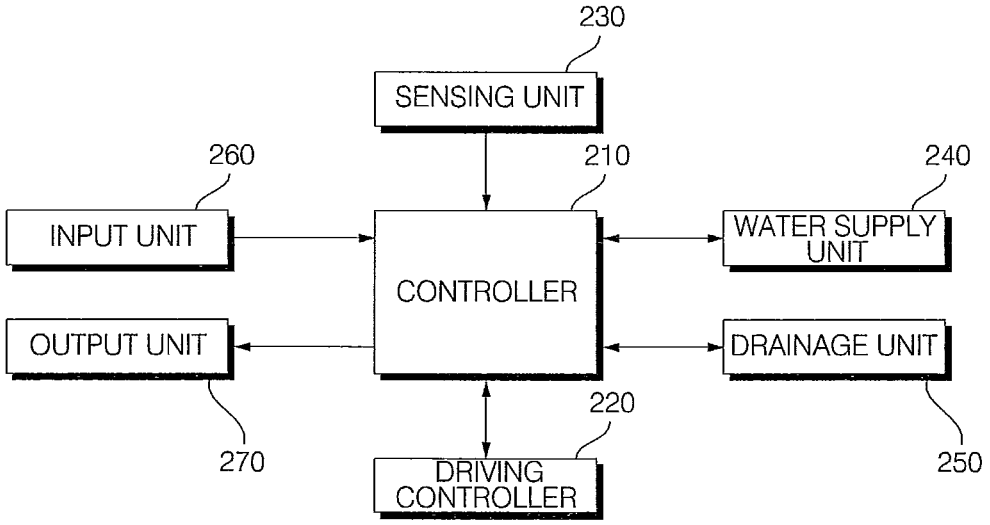
FIG. 3 is a block diagram illustrating a control configuration for controlling the operation of a washing machine according to an embodiment of the present invention.

FIG. 3 is a block diagram illustrating a configuration of controlling an operation of a washing machine according to an embodiment of the present invention.

This configuration performs washing, rinsing, and dehydrating processes on laundry, processes data generated during the processes, and controls the operation according to the washing, rinsing, and dehydrating processes.

Referring to FIG. 3, the washing machine 101 configured as shown in FIGS. 1 and 2 includes an input unit 260, an output unit 270, a driving controller 220, a water supply unit 240, a drainage unit 250, a sensor unit 230, and a controller 210 that controls the overall operation.

The washing machine 101 may further include a data unit that stores data.

The input unit 260 includes at least one input means that inputs a predetermined signal or data to the washing machine 101 in response to user's operation. The input unit 260 may include a button, a dome switch, a touch pad (static pressure/electrostatic), a jog wheel, a jog switch, a finger mouse, a rotary switch, a jog dial, or the like. However, the present invention is not limited thereto. For example, any devices may be employed as the input unit 260 as long as data may be input by pressing, rotating, or touching the device.

The input unit 260 receives data, such as an operation course and operation settings, according to the operation of the washing machine 101 and transmits the data to the controller 210.

The sensor unit 230 includes at least one sensing means that senses temperature, pressure, voltage, current, water level, number of rotation, or the like. And, the sensor unit 230 transmits the sensed data to the controller 210. For example, the sensor unit 230 measures the level of water when the water is supplied or discharged to/from the washing machine, and measures the temperature of the water and the rotation speed of the washing tub or drum.

The driving controller 220 controls the washing machine 101 in response to a control signal from the controller 210 so that the washing machine 101 may perform the set operation. Accordingly, the washing machine 101 may perform a series of operation, such as washing, rinsing, and dehydrating processes, to get rid of contaminants from the laundry.

For example, the driving controller 220 may drive a motor for rotating the washing tub or pulsator and control the operation thereof.

Further, the driving controller 220 may simultaneously or independently control the washing tub and the pulsator. While varying the operation of the washing tub or pulsator in response to a control command from the controller 210, the driving controller 220 may perform various patterns of washing operation.

The water supply unit 240 is connected to the washing machine 101 through, for example, a hose, to supply water to the washing machine 101, and the drainage unit 250 discharges the water used for washing to the exterior when washing was complete.

The water supply unit 240 and the drainage unit 250 open and close valves in response to a control command from the controller 210 and drive pumps to control the flow of internal water.

The controller 210 controls the flow of data, generates a control command according to data inputted from the sensor unit 230, or transmits the sensed data to the driving controller 220 to operate the washing machine. Further, the controller 210 sets operation data according to data inputted from the input unit 260 and controls the washing machine 101 so that the operational state of the washing machine 101 may be displayed on the output unit 270.

The output unit 270 may output the operational state of the washing machine 101 in the form of an image, a character, a numeral, or a sound. Further, the output unit 270 may output an alarm.

Figure 4:
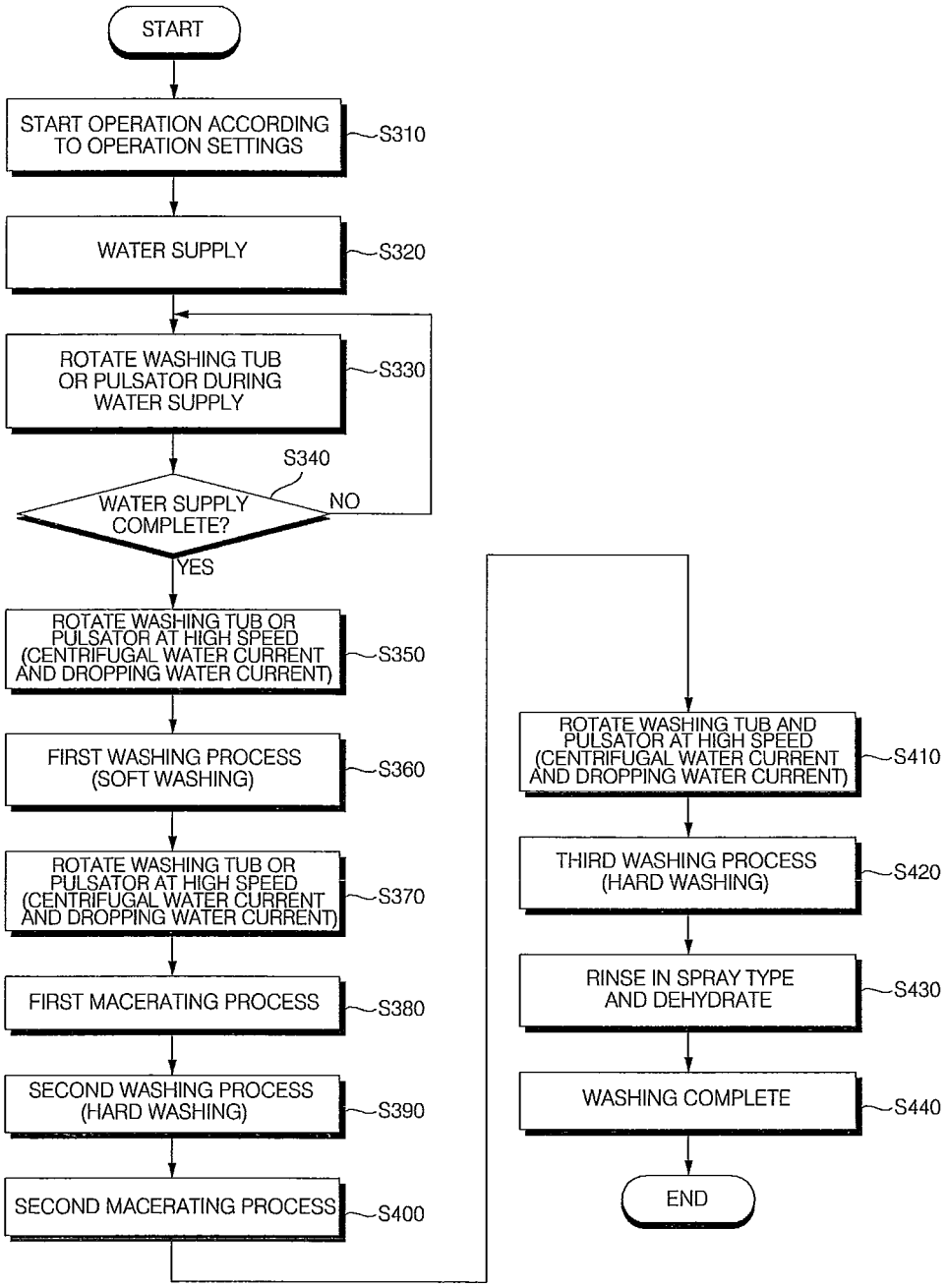
FIG. 4 is a flowchart illustrating a method of operating a washing machine according to a washing pattern according to an embodiment of the present invention.

FIG. 4 is a flowchart illustrating an operation according to a washing pattern of a washing machine according to an embodiment of the present invention.

In response to data inputted from the input unit 260, the controller 210 sets a washing course and transmits a control command to the water supply unit 240, the drainage unit 250, and the driving controller 220 to start the operation according to the set washing course (S310).

Washing water is supplied through the water supply unit 240 to the washing tub (S320). During the supply of water, the driving controller 220 controls a motor so that one of the washing tub and pulsator rotates. At the early stage of water supply, the washing tub 112 is rotated at a speed in one direction or its opposite direction so that detergent is supplied to the laundry together with the washing water (S330). This corresponds to step A that will be described below.

As necessary, the washing tub may stop rotation during the water supply while the pulsator may rotate so that the detergent can be mixed with the supplied water and melt by the water.

When the water reaches a predetermined level, a level sensor included in the sensor unit 230 senses the water level and transmits the water level to the controller 210. Accordingly, the controller 210 transmits a control command to the water supply unit 240 to stop water supply.

When the water supply is complete (S340), the driving controller 220 controls the motor in response to a control command from the controller 210 so that one of the washing tub 112 and the pulsator 113 may rotate at high speed (S350). This corresponds to step B that will be described below.

The high-speed rotation creates a centrifugal force in the washing tub. Accordingly, the washing water generates a centrifugal water current so that the laundry is pushed toward the inner wall of the washing tub by the washing water. Further, the washing water is discharged from the washing tub to the reservoir 111, moves to an upper portion of the reservoir 111 along the wall of the reservoir 111 by a rotational force of the washing tub or pulsator, and then drops into the washing tub.

When the laundry is moved to the upper portion of the reservoir 111 by the rotational force of the washing tub and then drops into the washing tub, a mechanical force is exerted to the laundry.

After the centrifugal water current is generated, the driving controller 220 performs a first washing process (S360) during which the driving controller 220 controls the pulsator 113 to alternately repeat rotation in one direction and rotation in the opposite direction so that the laundry may be rubbed against one another, thus generating a friction force to wash the laundry. The pulsator 113 reduces the rotation angle to perform a soft washing process. The pulsator 113 rotates in a direction during a predetermined time and then in the opposite direction during a predetermined time. The pulsator 113 may repeat such operation two or four times.

The laundry is not macerated enough to get rid of the contaminants during the first washing process because the first washing process is performed at the early washing stage. When washed with an excessive force, the laundry may be significantly damaged without being cleanly washed. Accordingly, the rotation of the pulsator is controlled to create a weak frictional force.

By rotating the pulsator 113 at high speed, the contaminants detached from the laundry may be clearly removed from the laundry and a new detergent is infiltrated into the laundry (S370). As necessary, if the pulsator was rotated only in one direction before the first washing process, the pulsator may be rotated in the opposite direction after the first washing process.

The driving controller 220 may macerate the laundry by alternately repeating the left and right operations by a small rotation angle so that the laundry may be slightly moved (S380). Because of the small movement, the laundry becomes such a condition where the contaminants may be easily detached from the laundry by the detergent having infiltrated into the laundry. During the macerating process, the laundry is not significantly moved.

When the laundry becomes a condition where the contaminants may be easily detached from the laundry by the macerating process, the driving controller 220 controls the pulsator 113 so that the pulsator 113 alternately repeats rotation in one direction and rotation in the opposite direction, thus performing a second washing process (S390). In this case, at least one of the rotation speed, the rotation direction, and the rotation angle of the pulsator is set to be greater than during the first washing process, so that a greater frictional force than during the first washing process may be created.

Accordingly, the contaminants are removed from the laundry. The second washing process has a stronger washing effect than that of the first washing process (S360). The first washing process and the second washing process may be called "soft washing process" and "hard washing process" which may mean a strong washing process, respectively.

In the second washing process, at least one of the rotation angle, the rotation speed, and the rotation time of the pulsator 113 is set to be greater than in the first washing process, and thus, the laundry is more significantly moved, thereby creating a larger frictional force than in the first washing process. Accordingly, the second washing process may provide an increased washing strength and improved detergency.

After the hard washing process, a macerating process is performed during which the pulsator 113 repeats slightly rotation in one direction and rotation in the opposite direction (S400). Since the rotation angle of the pulsator is small, the laundry is slightly moved so that the laundry becomes a condition where the contaminants may be easily removed from the laundry by the detergent infiltrated into the laundry. This is referred to as a second macerating process.

When the second macerating process is complete, the pulsator rotates at high speed to create a centrifugal force by which the laundry is pushed toward the inner wall of the washing tub and a water current is generated to drop the washing water (S410). Accordingly, the contaminants may be clearly removed during the hard washing process and the macerating process.

Further, the pulsator alternately repeats left and right turns so that a frictional force is created between the laundry (S420). A third washing process, a second hard washing process creating a high frictional force, finally separates and removes the contaminants from the laundry.

After untangling and untwisting the laundry, at least one of the washing tub and the pulsator rotates while supplying washing water, so that the contaminants and detergent are removed from the laundry.

Thereafter, a dehydrating process is performed, completing the washing process.

When the washing process is complete, a rinsing process and a dehydrating process are performed to finally complete the set washing course.

Figure 5:
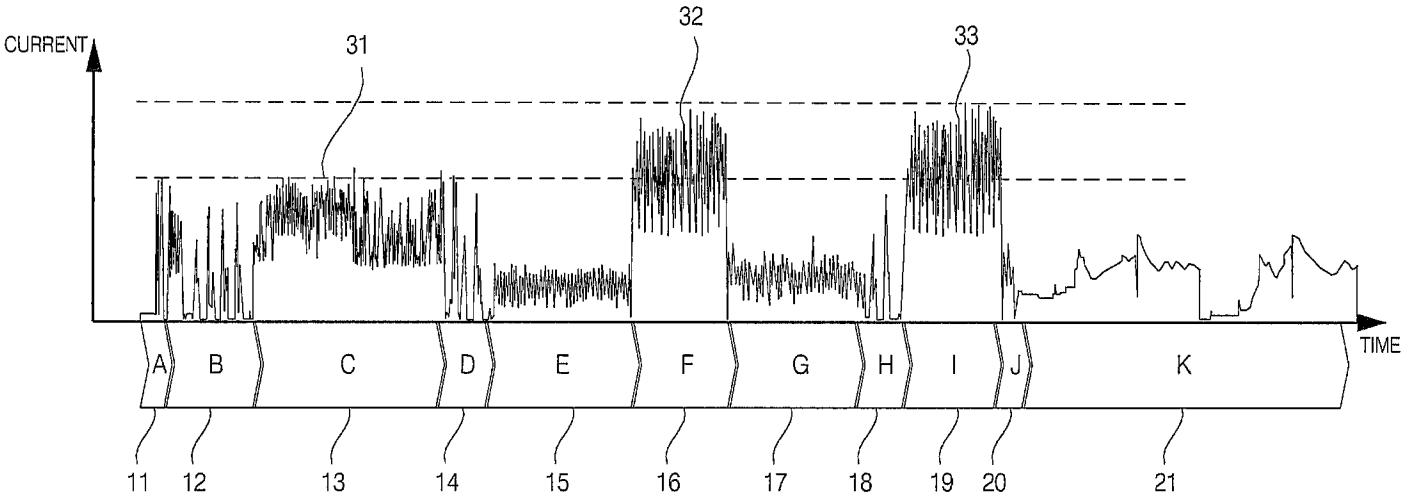
FIG. 5 is a view illustrating washing patterns of a washing machine according to an embodiment of the present invention.
Figure 6:
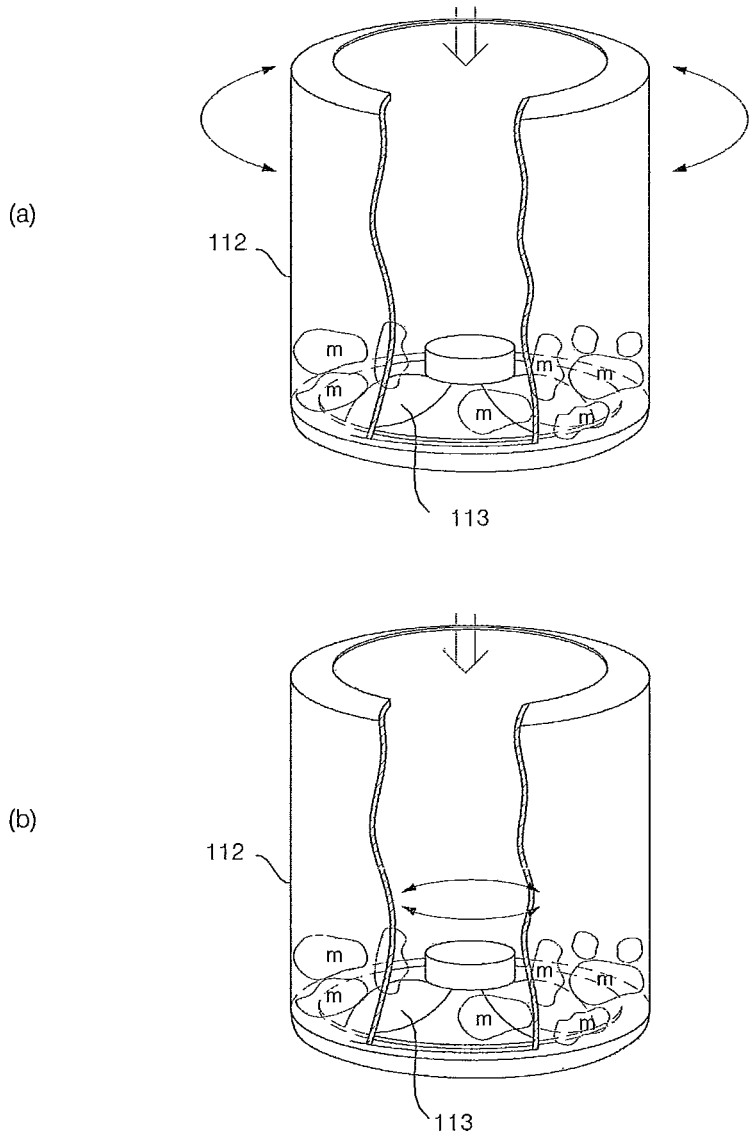
FIGS. 6 to 13 are views illustrating the operation of a washing tub or a pulsator according to the washing patterns shown in FIG. 5.
Figure 7:
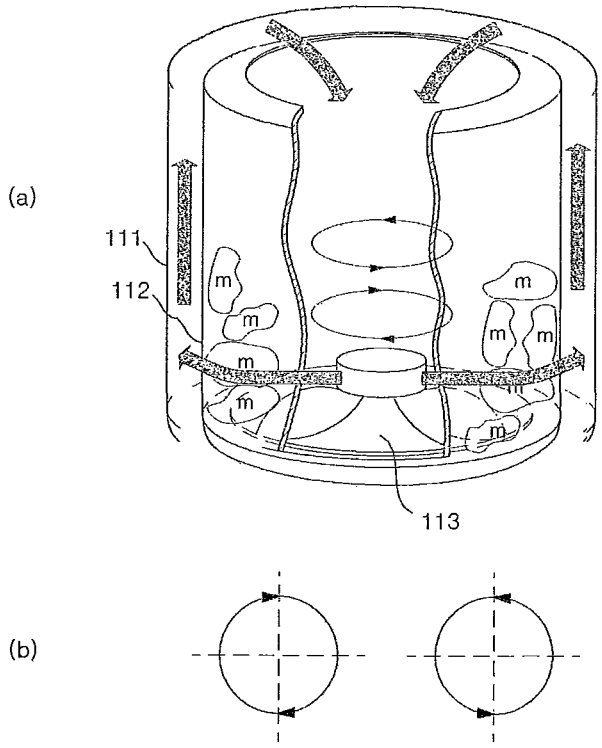

FIG. 5 is a view illustrating a washing pattern of a washing machine according to an embodiment of the present invention. FIG. 5 illustrates variations of current applied to a motor according to a washing pattern. FIGS. 6 to 13 are views illustrating the operation of a washing tub or a pulsator according to the washing pattern shown in FIG. 5.

In the washing machine configured as above, the laundry in the washing tub may be moved in various forms by varying the operation of the washing tub 112 or the pulsator 113 while the washing process is performed.

A user puts laundry in the washing tub and inputs a washing course through the input unit 260 to remove contaminants from the laundry. Operational data regarding the type of supplied water or additional process, as well as the washing course may be inputted.

When the washing course is inputted, the controller 210 sets a water level and operation depending on the amount of laundry. The washing course may be variously set, for example, depending on the type or washing strength of the laundry. For example, the washing course may include a standard course, a speedy course, a jeans course, a blanket course, a wool course, or the like.

When the washing machine 101 starts to operate, the water supply unit 240 supplies washing water to the washing tub. Since the washing water is supplied to the washing tub via a detergent drawer, detergent may also be supplied to the washing tub.

When a washing course is determined, the controller 210 performs a washing process corresponding to the laundry. The controller 210 may divide the washing process into a plurality of steps and control each of the plurality of steps.

For example, as shown in FIG. 5, a plurality of steps A to K (11 to 21) may be included in the washing process. The controller 210 transmits a control command corresponding to each step to the driving controller 220, and the driving controller 220 transmits a driving signal to a motor so that the washing tub 112 or the pulsator 113 is differently operated for each step.

In step A (11), the controller 210 allows washing water to be supplied to the washing tub 112 through the water supply unit 240 and at the same time transmits a control signal to the driving controller 220 so that the washing tub 112 rotates in one direction. After a predetermined time, the rotational direction may be changed.

The water supply may be continued from step A up to step B, and, if the water reaches a predetermined level, the water supply stops. As the washing tub 112 rotates at a first rotation speed in the one direction in step A, detergent is supplied to the laundry along with the washing water.

In step A, as shown in FIG. 6A, as the washing water is supplied to the washing tub, the washing tub 112 among the washing tub 112 and the pulsator 113 rotates in one direction. As the washing tub 112 rotates, the washing water and the detergent may be uniformly supplied to the laundry.

As necessary, during the water supply, only the pulsator 113 may rotate in one direction while the washing tub 112 remains stationary, and after a predetermined time, the pulsator 113 may rotate in the opposite direction to supply the washing water and the detergent to the laundry.

In step B (12), the controller 210 transmits a control command to the driving controller 220 so that one of the washing tub 112 and the pulsator 113 may rotate in one direction at a second speed higher than the first rotation speed of step A (11). The second rotation speed which is higher than the first rotation speed is a speed at which the laundry may be pressingly pushed toward the inner wall of the washing tub due to a centrifugal force generated by the second rotation speed.

In step B, the high-speed rotation in one direction may be repeated two or four times. As necessary, after the high-speed rotation in one direction, high-speed rotation in the opposite direction may be performed.

In step B, as one of the washing tub 112 and the pulsator 113 rotates at high speed, a centrifugal force is created in the washing tub 112. Accordingly, the washing water and detergent supplied in step A are moved toward the inner wall of the washing tub 112 due to the centrifugal force generated in the washing tub. The laundry is pressingly pushed toward the inner wall of the washing tub 112 while being distributed along the inner wall of the washing tub 112 together with the washing water. Accordingly, the washing water holding the detergent is uniformly infiltrated into the laundry so that the contaminants may be easily removed from the laundry by the detergent.

Further in step B, the washing water generates a centrifugal water current in the washing tub 112 by a centrifugal force created by the high-speed rotation, and moves toward the inner wall of the washing tub 112 and then to the upper portion of the washing tub. As the washing water is moved, the laundry is moved toward the inner wall of the washing tub 112 and pressingly pushed against the inner wall of the washing tub 112. The washing water is externally discharged from the washing tub 112 through a hole included in the washing tub 112. Accordingly, the washing water and the detergent may be deeply infiltrated into the laundry.

The washing water externally discharged from the washing tub 112 is stored in the reservoir 111, and moved to the upper side of the reservoir 111 due to a rotational force generated in the washing tub 112 as the washing tub 112 or the pulsator 113 rotates. The washing water moved to the upper side of the reservoir 111 collides with a reservoir cover (not shown) connected to the upper side of the reservoir 111 and then drops from the upper side of the reservoir 111 into the washing tub 112 by reaction due to the collision.

As the washing tub 112 rotates, the washing water discharged to the reservoir 111 moves to the upper side of the reservoir 111 and then drops into the washing tub 112. Accordingly, the dropping washing water creates a mechanical force by which the contaminants are removed from the laundry.

In step B, as shown in FIGS. 7A and 7B, one of the washing tub 112 and the pulsator 113 rotates at a second rotation speed in one direction and thus a centrifugal force is created in the washing tub 112, so that the washing water and the laundry are moved toward and pressingly pushed against the inner wall of the washing tub 112. Further, the washing water is moved toward the inner wall of the washing tub 112 and then discharged to the reservoir 111 via the hole included in the washing tub. Then, the washing water moves to the upper side of the reservoir 111 by a rotational force and then drops into the washing tub 112.

Figure 8:
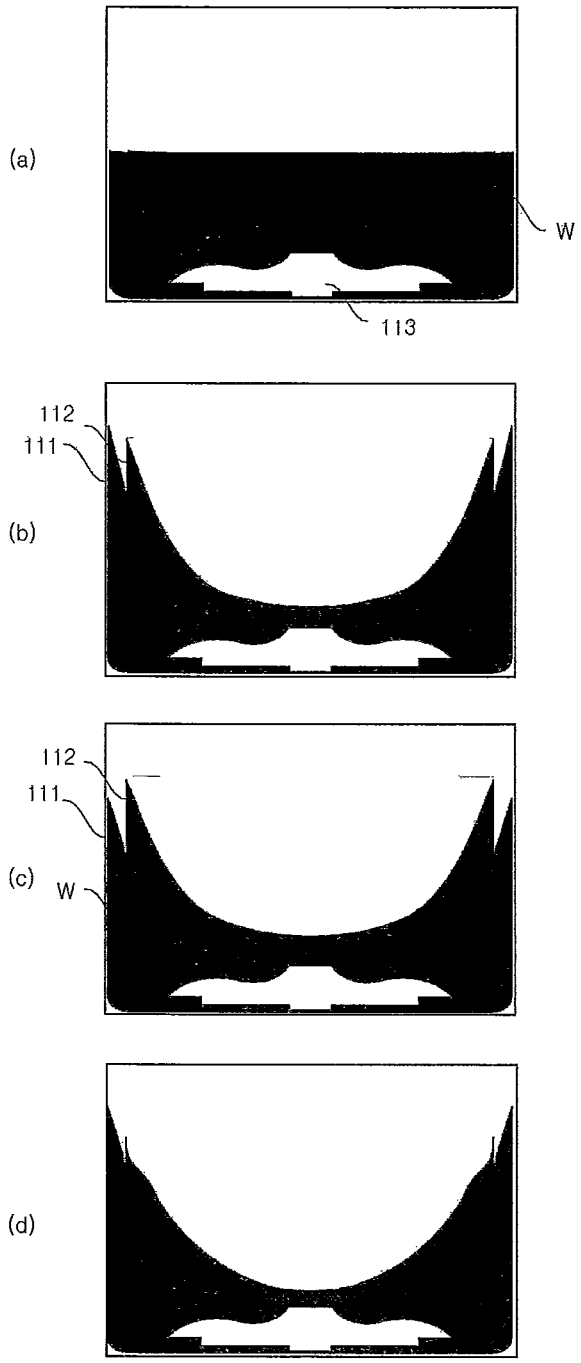

The flow of the washing machine in the reservoir 111 and the washing tub 112 is as shown in FIG. 8.

After the washing water W is supplied to the reservoir 111 and the washing tub 112 as shown in FIG. 8A, if one of the washing tub 112 and the pulsator 113 starts to rotate in step B, the washing water in the washing tub 112, as shown in FIG. 8B, is moved toward the inner wall of the washing tub 112.

As the rotation of the washing tub 112 continues as shown in FIG. 8C, the flow of the washing water W toward the inner wall of the washing tub 112 is accelerated, and at the same time, the washing water W is discharged to the reservoir 111 so that the washing water in the reservoir 111 is gradually moved to the upper side of the reservoir 111. As shown in FIG. 8D, the washing water in the washing tub 112 is reduced and the washing water in the reservoir 111 is increased. And, the washing water is moved to the upper side of the reservoir 111 and then collides with the upper side of the reservoir 111, thus dropping into the washing tub 112.

When the above operation is complete, the controller 210 performs a first washing process for getting rid of the contaminants from the laundry.

Figure 9:
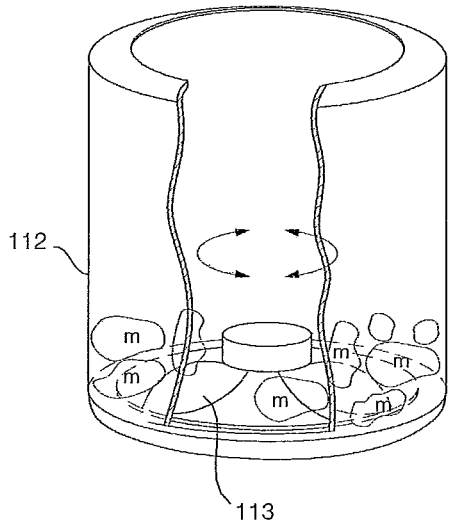
Figure 9:
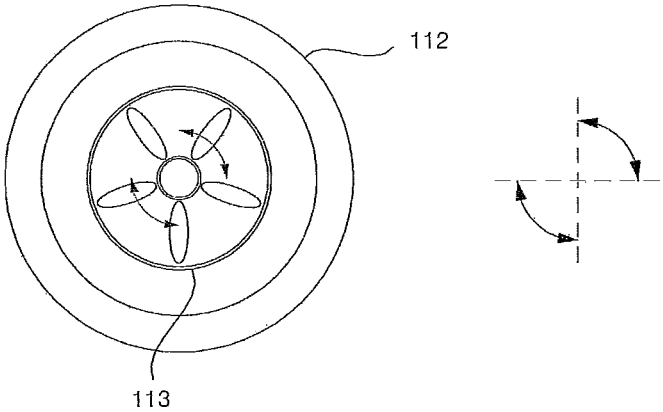

In step C (13), the driving controller 220, as shown in FIG. 9, controls the pulsator 113 so that the pulsator 113 alternately repeats rotation in one direction by a first rotation angle during a predetermined time at a third rotation speed lower than the second rotation speed and rotation in the opposite direction.

The driving controller 220 may perform such operation for one hour. When the pulsator 113 rotates by the first rotation angle, the laundry may rotate by about 90 degrees. Such an angle may vary with the amount and type of the laundry.

In step C (13), since the pulsator 113 rotates by the first rotation angle, the movement of the laundry is not significant. However, because of alternately repeating rotational operation, a frictional force between the laundry during the rotation and a frictional force between the laundry as the direction of rotation is changed are increased, thus providing the same effect as washing the laundry by rubbing the laundry by hands. In step C (13), since the laundry is slightly moved, a first frictional force is exerted to the laundry so that the contaminants are partially removed from the laundry.

Step D (14) is performed as the above-described step B. As the pulsator 113 rotates at the high second speed, the contaminants removed from the laundry by the effect of rubbing the laundry are swiftly separated and removed from the laundry by the centrifugal water flow, and detergent is newly infiltrated into the laundry by the washing water.

In step D (14), as described in step B, as the washing water is flowed toward the inner wall of the washing tub 112, the laundry is moved toward and pushed against the inner wall of the washing tub 112 correspondingly. Further, the washing water is discharged to the reservoir 111, moved to the upper side of the reservoir 111 by a rotational force, and then drops into the washing tub 112. Due to the force of dropping water, the contaminants are partially removed from the laundry and detergent is infiltrated into the laundry.

In step E (15), the driving controller 220 controls the pulsator 113 so that the pulsator 113 rotates by the second rotation angle smaller than the first rotation angle of step C for two hours. As the pulsator 113 rotates at a fourth rotation speed lower than the first rotation speed, the laundry partially causes a slight movement, but the position is not significantly changed.

Figure 10:
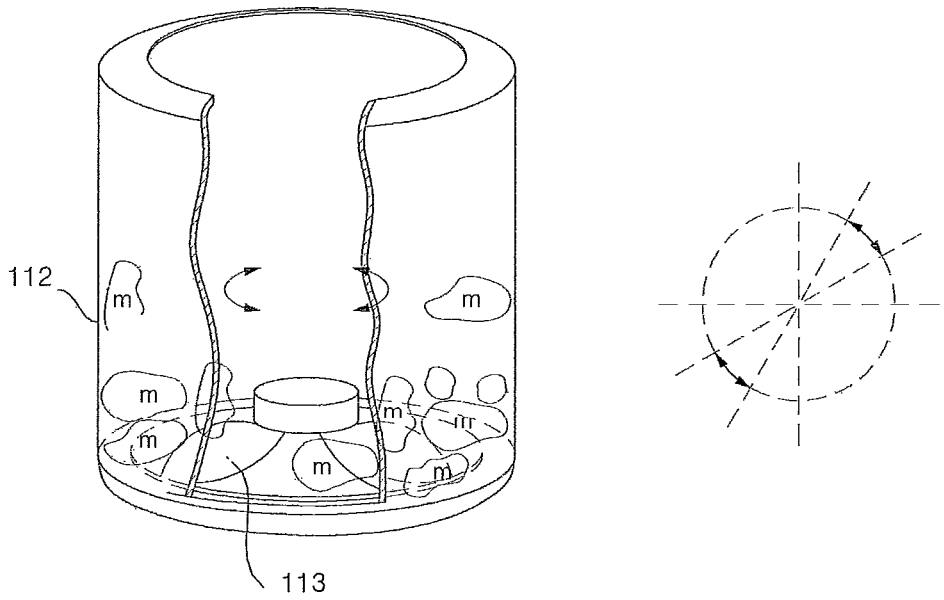
Figure 11:
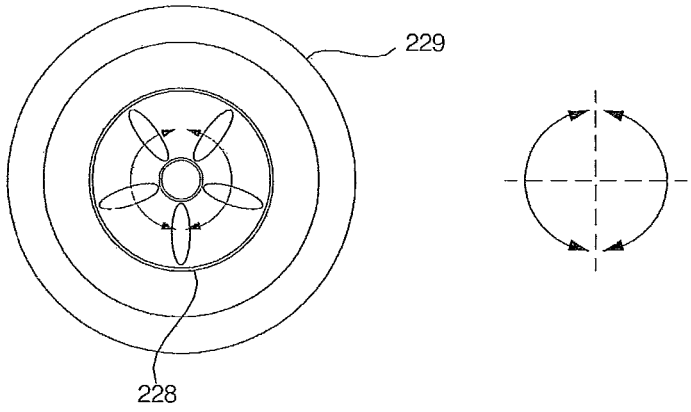

As shown in FIG. 10, the pulsator 113 repeats the operation of rotating in one direction by a second rotation angle and then rotating in the opposite direction. A third rotation angle may be set to have a range of 0 to 70 degrees. The third rotation angle may be in the range of about 30 degrees or about 45 degrees within which the laundry is not significantly moved.

Since the pulsator 113 is moved by a rotation angle smaller than a rotation angle of the first washing process, a frictional force smaller than a frictional force generated in the first washing process is created. However, since such operations are conducted after steps C and D, the contaminants deeply infiltrated into the laundry become a condition of being capable of being easily removed from the laundry. That is, in step E, since the pulsator 113 operates such that the laundry is not significantly moved, a macerating effect may be achieved that macerates the laundry so that the contaminants may be easily removed from the laundry by the detergent infiltrated into the laundry.

After, in step C, the washing process of partially detaching the contaminants from the laundry by rotation of the pulsator in a similar manner to washing the laundry by rubbing the laundry by hands, the detached contaminants are removed in step D. Thereafter, in step E, the macerating step, the laundry becomes a condition where the contaminants deeply infiltrated into the laundry may be easily removed from the laundry by detergent.

In this case, current consumption is reduced as much as the operation of the pulsator 113 is decreased. In steps A to D, the peaks of the consumed current are similar to one another. However, in step E, the peak is less than ½ of the peaks of consumed current in steps A to D.

In step F (16), the driving controller 220 controls the pulsator 113 so that the pulsator 113 alternately repeats rotation in one direction and rotation in the opposite direction as performed in step C. However, in step F (16), the driving controller 220 enables the pulsator 113 to rotate by a third rotation angle larger than the first rotation angle of step C which is the first washing process, thus leading to an strong washing effect.

In this case, the driving controller 220 enables the pulsator 113 to operate at a rotation speed similar to or higher than a rotation speed of step C. However, the rotation speed is lower than the second rotation speed of step B. Further, the driving controller 220 controls the pulsator 113 so that the pulsator 113 alternately repeats rotation in one direction and rotation in the opposite direction for a second time shorter than the first time. Since the second washing process is a hard washing process, i.e., strong washing process, a long-term operation may increase the wear of the laundry. Accordingly, the second washing process may be performed shorter than the first washing process.

In step F (16), since the pulsator alternately repeats left and right turns within a predetermined rotational angle as performed in step C (13), a frictional force is created between the laundry, thus providing a similar effect to washing the laundry by rubbing the laundry by hands. In step F (16), however, the pulsator operates by a rotation angle larger than the rotation angle of step C (13), and thus, the movement of the laundry is increased. Accordingly, step F may create a frictional force greater than a frictional force of step C, thus increasing detergency.

Further, a current 32 supplied to a motor in step F becomes larger than a current 31 supplied to a motor in step C. In step F, the pulsator rotates at a speed lower than a speed of step B, but the pulsator alternately repeats rotation in one direction and rotation in the opposite direction. Thus, in step F, the pulsator sequentially performs rotation in one direction, reduction in speed, and then rotation in the opposite direction, and thus, more current consumption occurs than in step B performing rotation in one direction.

In step F, the pulsator alternately repeats the rotational operations as shown in FIG. 9. However, in step F, the pulsator alternately repeats rotation in one direction up to a third rotation angle larger than the first rotation angle of step C and rotation in the opposite direction, so that the movement of the laundry is significantly increased. Accordingly, a frictional force is increased to improve the effect of rubbing the laundry, thereby increasing detergency. The third rotation angle may be set to be greater than the first rotation angle by 1.5 to 3 times.

As the pulsator 113 rotates by the third rotation angle in step F which is the second washing process, the laundry may be rotated by about 180 degrees. However, the angle may vary with the amount or type of the laundry.

In the washing processes, such as steps C and F, the movement of the laundry is as follows.

Figure 12:
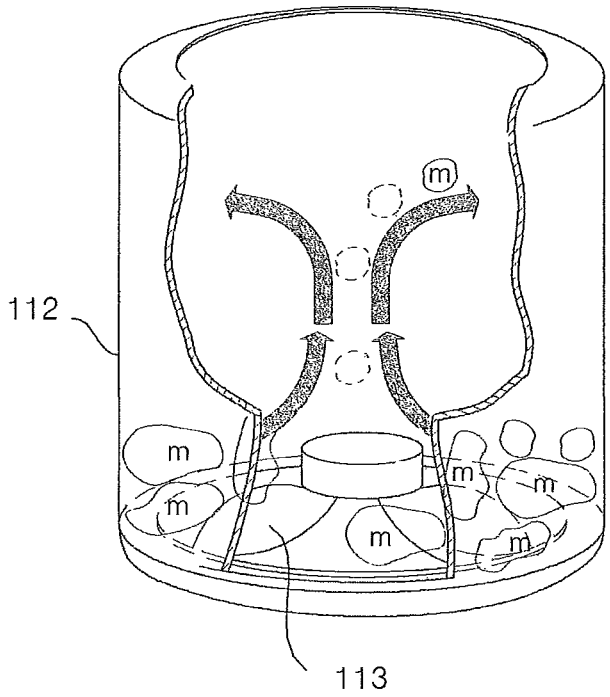

As shown in FIG. 12, when the pulsator 113 rotates at a predetermined speed in one direction, and then rotates in the opposite direction, washing water is flowed from the lower central portion of the washing tub 112 to the upper portion due to a rotational force of the pulsator 113 and then radially distributed from the upper central portion toward the inner wall of the washing tub 112. This procedure also applies to a third washing process which corresponds to step I that will be described below.

As the washing water flows as above, the laundry positioned at the lower central portion of the washing tub is moved to the upper side, and the laundry positioned at the upper central portion is radially distributed toward the inner wall of the washing tub.

Accordingly, rather than being merely moved in the left and right directions so that a left and right direction friction force is only exerted to the laundry, frictional force may be exerted to the laundry from upper, lower, left, and right directions, thereby improving detergency.

In step C, the first washing process and the second washing process have the same principle, but different detergency because they have different degrees of movement of laundry and different frictional forces from each other.

In step C, some contaminants weakly attached to the laundry are removed from the laundry by a frictional force between the laundry. Although, in step C, detergent is infiltrated into the laundry by a centrifugal water current generated in step B after water supply, the detergent has little effects on the contaminants and thus contaminants deeply infiltrated into the laundry are not yet removed. Accordingly, when a frictional force is exerted to the laundry as in step F, the wear of the laundry is increased without increase of washing effect.

Since, in step C, a weaker frictional force than a frictional force of step F is exerted to the laundry, an effect is generated that smoothly rubs the laundry while washing.

In step F, some of the contaminants have been already removed from the laundry by the first washing process of step C while the laundry has been macerated. Accordingly, in step F, a higher frictional force than a frictional force of step C may be created by alternately repeating rotating the pulsator in one direction and rotating the pulsator in the opposite direction, thereby removing the contaminants. Accordingly, a high washing effect may be achieved.

Although, in step E which is a macerating process, the pulsator alternately repeats rotation in one direction and rotation in the opposite direction, the rotation angle is too small to significantly move the laundry. Accordingly, the laundry is not moved from the lower side to the upper side as described above.

In step G (17), a macerating process is repeated as in step E.

In step H (18), the pulsator rotates at high speed, for example, at the second rotation speed as in step B (12) or D (14) so that the contaminants removed from the laundry in steps F and G are completely separated from the laundry and new detergent is infiltrated into the laundry.

In step I (19), a third washing process after step H is performed. The pulsator alternately repeats rotation in one direction by the third rotation angle and rotation in the opposite direction, thus performing the last hard washing process, that is, strong washing process.

Step I (19) is a washing step that has similar detergency to washing the laundry by rubbing the laundry by hands, as described above. In step I, the contaminants that were not removed in step F are finally washed out. Step I also consumes as much current 33 as step F consumes.

In step J (20) after step I (19), a process is performed to prevent the laundry from being tangled.

Thereafter, in step K (21), washing water is sprayed to the laundry ("spraying type") while at least one of the washing tub and the pulsator is rotated, so that the laundry may be rinsed by the force of sprayed water. In step K, the sprayed range may be adjusted. The contaminants and detergent detached from the laundry may be got rid of by the force of sprayed water over the sprayed range.

As described above, the washing cycle is divided into a plurality of steps and the operation of the washing tub or pulsator is differently performed for each step. Accordingly, the movement pattern of the laundry may be variously changed for each step, and a better washing effect may be thereby achieved.

And, at the early stage of the washing cycle, the contaminants are not sufficiently macerated. Accordingly, a weak frictional force is created by smoothly alternating between rotation in one direction and rotation in the opposite direction, and the first washing process is performed using the weak frictional force to minimize the wear of the laundry. As the washing cycle proceeds, the macerating process is performed and thereafter a strong washing process is performed so that a high frictional force is exerted to the laundry, thus increasing detergency.

Figure 13:
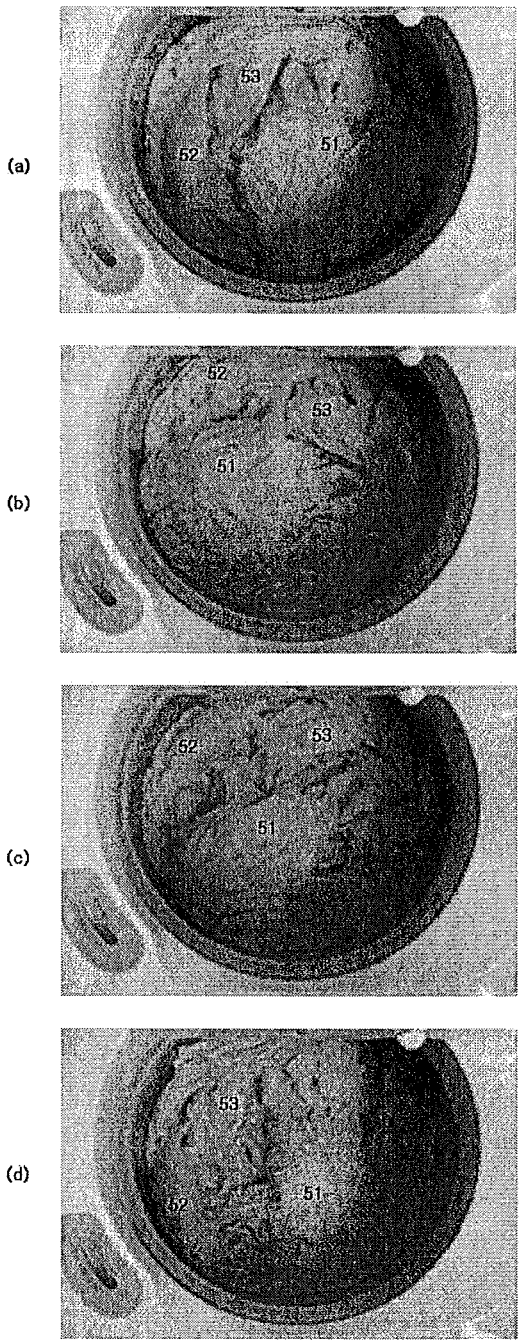

FIG. 13 illustrates examples of the movement of laundry in a washing process. Specifically, FIG. 13 illustrates examples in which the laundry is moved in steps C (13), F (16), and I (19), especially step C corresponding to a smooth washing process. Although, in step C (13) performing a smooth washing process, the movement of laundry is weaker than in steps F and I performing a strong washing process, the principle is not different between step C and steps F and I. Further, the movement of laundry in the washing process may vary with the type or amount of laundry.

FIG. 13 illustrates variations with time in the movement of first laundry 51, second laundry 52, and third laundry 53 put in the washing tub 112 in a washing process, such as step C. FIGS. 13A, 13B, and 13C illustrate the movement of laundry captured by an interval of two seconds, and FIG. 13D illustrates the movement of laundry captured four seconds after captured in FIG. 13C.

It can be seen that the interval between the first to third laundry 51, 52, and 53 increases over time. In particular, a comparison between FIGS. 13A and 13D shows that the interval between the laundry 51, 52, and 53 was significantly expanded.

This means that the laundry is distributed from the central portion of the washing tub 112 toward the inner wall of the washing tub 112. Accordingly, it can be seen that rather than the laundry is merely moved, new laundry may be lifted from the lower portion of the washing tub 112 to between the first to third laundry 51, 52, and 53.

As described above, a washing capability may be improved by controlling the washing tub and the pulsator in various patterns during a washing cycle. In particular, by making the washing strength different, for example, performing a soft washing process and a hard washing process different from each other, at the early stage of washing, the contaminants are lightly removed without unnecessary energy consumption and with reduced wear of the laundry, and at the later stage of washing, the contaminants may be completely removed through a strong washing process. Accordingly, washing may be efficiently performed.

Although a washing machine and a method of operating the washing machine according to an embodiment have been described with reference to the accompanying drawings, a number of variation or modifications to the present invention may be made within the spirit or ranges of the claims without being limited to the embodiment and drawings.

What is claimed is:

1. A method of operating a washing machine comprising:

an infiltrating detergent process that, after supplying washing water to a washing tub, rotates one of the washing tub and a pulsator at a first speed in a direction so that the washing water and a laundry are moved toward and pushed against an inner wall of the washing tub, and infiltrates detergent into the laundry;

a first washing process that alternately repeats rotating the pulsator in a direction by a first rotation angle and rotating the pulsator in an opposite direction during washing laundry to create a first frictional force between the laundry and separating contaminants from the laundry using the first frictional force;

a first macerating process that alternately repeats rotating the pulsator in a direction by a second rotation angle smaller than the first rotation angle and rotating the pulsator in an opposite direction by the second rotation angle;

a second washing process that alternately repeats rotating the pulsator in a direction by a third rotation angle bigger than the first rotation angle and rotating the pulsator in an opposite direction during washing laundry to create a second frictional force larger than the first frictional force between the laundry and separating contaminants from the laundry using the second frictional force, wherein the first speed is higher than a speed of the second washing process; and a third washing process that alternately repeats rotating the pulsator in a direction and rotating the pulsator in an opposite direction to create a third frictional force between the laundry and further separates the contaminants from the laundry using the third frictional force.

2. The method of claim 1, further comprising:

after the first washing process, rotating one of the washing tub and the pulsator at the first speed in a direction so that the laundry is moved toward and pushed against an inner wall of the washing tub; and removing the contaminants separated from the laundry using a force generated when the washing water is dropped from an upper side of a reservoir into the washing tub, wherein the washing water discharges to the reservoir and flows to the upper side of the reservoir by rotational force of one of the washing tub and the pulsator.

3. The method of claim 1, further comprising:

prior to the third washing process, a second macerating process that alternately repeats rotating the pulsator in a direction by the second rotation angle smaller than the first rotation angle and rotating the pulsator in the opposite direction.

4. The method of claim 1, further comprising:

prior to the third washing process, rotating one of the washing tub and the pulsator at the first speed higher than the speed of the second washing process in a direction so that the laundry is moved toward and pushed against an inner wall of the washing tub; and removing the contaminants separated from the laundry during the second washing process using a force generated when the washing water is dropped from an upper side of a reservoir into the washing tub, wherein the washing water discharges to the reservoir and flows to the upper side of the reservoir by rotational force of one of the washing tub and the pulsator.

5. The method of claim 1, wherein during the first washing process and the second washing process, laundry positioned at a lower central portion of the washing tub is moved to an upper portion of the washing tub and laundry positioned at the upper portion of the washing tub is radially distributed from a central portion toward an inner wall of the washing tub.

6. The method of claim 5, wherein the first frictional force and the second frictional force are exerted to between the laundry from upper, lower, left, and right directions.

7. The method of claim 1, wherein the second washing process increases at least a rotation speed of the pulsator more than the first washing process so that the second frictional force larger than the first frictional force is created between the laundry.

* * * * *